United States Patent [19]

Onda

[11] 4,249,584

[45] Feb. 10, 1981

[54] CARPENTER PLANER

[75] Inventor: Hirotsugu Onda, Seki, Japan

[73] Assignee: Onda Ironworks Company, Ltd., Seki, Japan

[21] Appl. No.: 55,299

[22] Filed: Jul. 6, 1979

[30] Foreign Application Priority Data

Jul. 13, 1978 [JP] Japan ..... 53-96958[U]
Jul. 14, 1978 [JP] Japan ..... 53-97791[U]

[51] Int. Cl.[3] ..... B27C 1/00
[52] U.S. Cl. ..... 144/120; 144/3 A
[58] Field of Search ..... 144/3 A, 3 S, 120, 114 R, 144/162 R, 162 A, 175, 130

[56] References Cited

U.S. PATENT DOCUMENTS 3,783,917 1/1974 Mochizuki ..... 144/120 X
4,060,112 11/1977 Leeper, Jr. ..... 144/114 R X

*Primary Examiner*—Willie G. Abercrombie
*Attorney, Agent, or Firm*—Jordan and Hamburg

[57] ABSTRACT

A carpenter planer in which a stock reciprocatingly moved on a stock feeder table by a stock feeding belt can be cut during both the forward movements and backward movements of the stock. On the stock feeder table, a knife stock is provided via rotary disc such that a planer blade can be turned round in accordance with the direction in which the stock is moved. When a stock is fed from a front portion of a planer base onto the upper surface of the stock feeder table, it is moved toward the rear portion of the planer base by a stock feeding belt. The stock is cut by a planer blade while it is moved in the above-mentioned manner. When the rear end of the stock comes off rearwardly from the upper surface of the rotary disc, the rotation of the stock feeding belt is interrupted as the stock is kept pressed on the stock feeder table by the stock feeding belt. The rotary disc is thereafter turned in the opposite direction and the planer blade is turned in a different direction. The stock feeding belt is then rotated in the backward direction. When the feeding belt is backwardly rotated, the stock is returned to the front portion of the planer base while being cut again by the planer blade. The stock thus cut again is discharged ahead of the front portion of the planer base through a space between the stock feeder table and the stock feeding belt. After the stock has been discharged, the rotary disc is turned again in the opposite direction to allow the planer blade to be turned in the opposite direction. The stock feeding belt is then forwardly rotated for the preparations of the following stock cutting operation.

7 Claims, 5 Drawing Figures

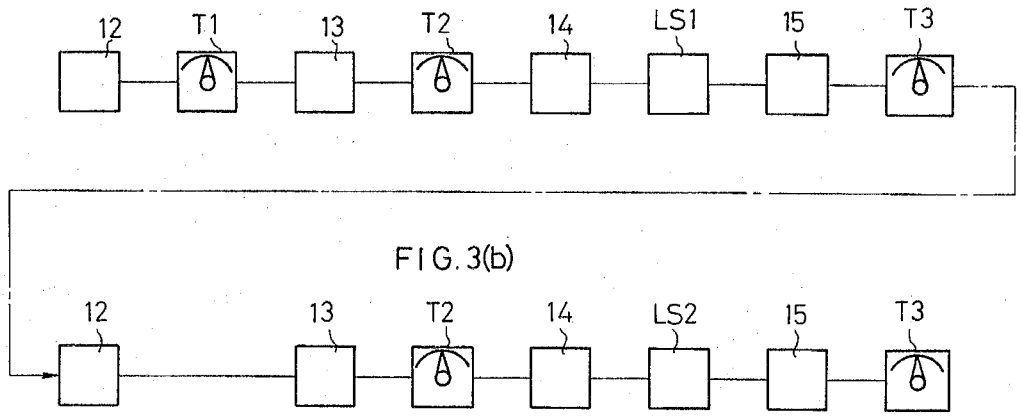
FIG. 3(a)
FIG. 3(b)
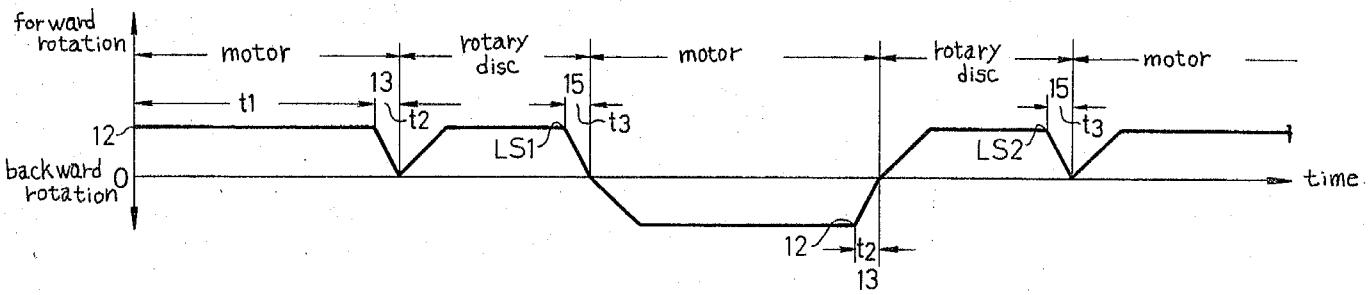
FIG. 4

CARPENTER PLANER

BACKGROUND OF THE INVENTION

1. Field of the Invention

The present invention relates to a carpenter planer and, more particularly, to a carpenter planer in which a stock reciprocatingly moved on a stock feeding table is cut during both the forward movements and backward movements of the stock.

2. Summary of the Invention

An object of the present invention is to provide a carpenter planer in which a motor for driving a stock feeder unit can be prevented by simple means from being burnt during returning movements of the stock, that is, when the motor is braked to turn a rotary disc.

Another object of the present invention is to provide a carpenter planer which prevents a stock, upon its feeding, from being sprung outwardly through a space between a stock feeder unit and a stock feeder table by the actions of a rotary disc, so as to protect an operator from being hurt by the stock.

To these ends, the present invention provides a carpenter planer comprising a stock feeder table mounted on a planer base, a stock feeder unit which is provided on the stock feeder table such that the position of the stock feeder unit can be vertically regulated and which is forwardly and backwardly driven by a motor so as to reciprocatingly move the stock on the stock feeder table, a knife stock which is rotatably provided on the stock feeder table via a rotary disc so as to cut the stock being fed by the stock feeder unit and which has a planing blade which can be turned in accordance with the direction in which the stock is moved, and a control unit for controlling the movement of the stock feeder unit and rotation of the rotary disc during the feeding of the stock, the carpenter planer being characterized in that the control unit consists of a means for breaking an electric circuit leading to the motor when the rear end of the stock forwardly moved by the stock feeder unit on the stock feeder table has been advanced within a stoppage tolerable range between a position which is away from the rotary disc and a position where the stock is released from the force of the stock feeder unit exerted thereon, a brake means connected to the circuit breaking means so as to start braking the motor after the electric circuit has been broken, and a timer connected to the brake means so as to terminate the braking of the motor when a predetermined period of time has elapsed after the motor braking operation was started, and thereby allow the rotary disc to be operated.

Other and further objects of this invention will become clear upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

FIG. 3*a* is a block diagram of a stock feeder and cutter unit;

FIG. 3*b* is a block diagram of a stock returning and cutting unit; and

FIG. 4 is a diagram for illustrating the process for cutting the stock.

DESCRIPTION OF THE PREFERRED EMBODIMENT

Figure 1:
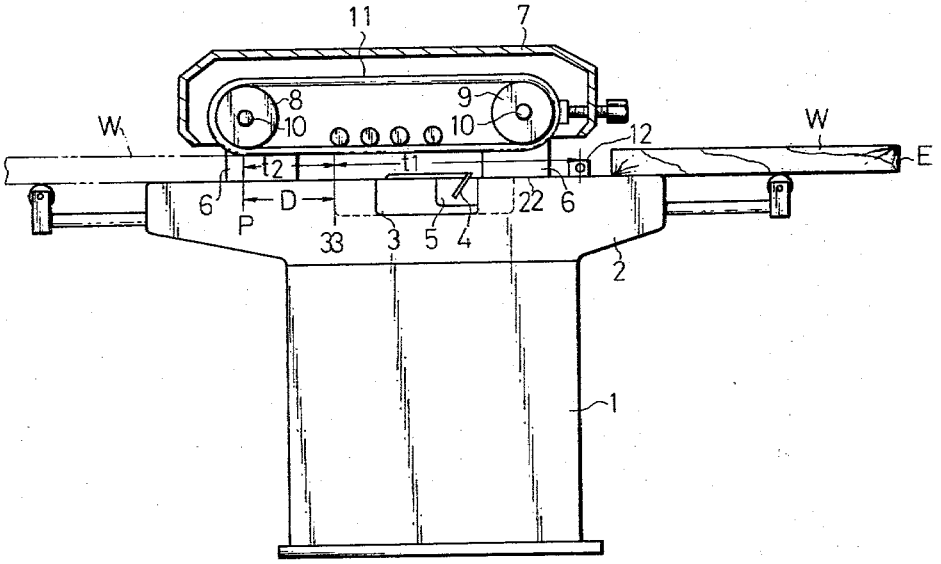
FIG. 1 is a schematic elevational view of a carpenter superfinishing planer embodying the present invention.

A carpenter superfinishing planer embodying the present invention will be described with reference to the accompanying drawings.

Referring to the drawings, reference numeral 1 denotes a planer base, 2 a stock feeder table, 3 a rotary disc actuated by a drive means 14 which is provided in the central portion of a stock feeder surface 22 of the stock feeder table 2 and which will be described later, and 5 a knife stock which is withdrawably fitted in the rotary disc 3 and which has a planing blade 4 at the upper surface 23 of the rotary disc 3, the planing blade 4 being extended in the direction of the diameter of the rotary disc 3.

Reference numeral 6 denotes a pair of posts set up at a side of the upper surface of the planer base 1, 7 a cover fixed for vertical movement to the posts 6 such that the cover encloses a lift member (not shown), 8 and 9 a drive roll and a driven roll rotatably supported on shafts 10 which are spaced by a suitable distance. Reference numeral 11 denotes a stock feeding belt wrapped around the rolls 8, 9 and can be rotated forwardly and backwardly by a reversible motor (not shown) connected to the drive roll 8.

Reference numeral 12 denotes a detection means disposed by such a portion of the stock feeder surface 22 that is on the feed side (right-hand side in FIG. 1) of the stock feeder table 2 to detect the passage of the stock W. The detection means 12 emits supersonic waves or light rays to a stock W being fed and receives reflected waves to detect the passage thereof. A limit switch or a phototube may be used for the detection means 12.

FIG. 3*a* shows a block diagram of each elements in a step of feeding a stock W. Reference symbol $T_1$ denotes a timer connected to the detection means 12 to start counting when the detection means 12 senses the passage of the stock W, and turn off the power source for the stock driving motor when a predetermined period of time has elapsed after the counting was started.

Figure 2:
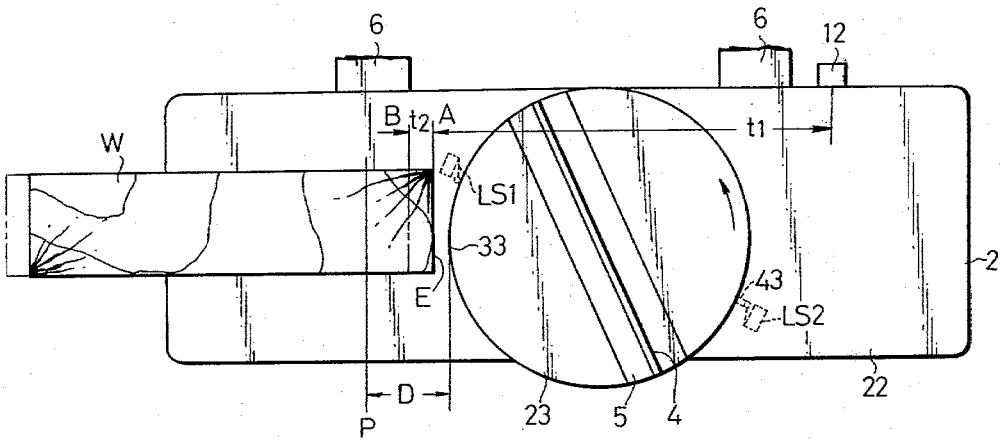
FIG. 2 is an enlarged plan view of a stock feeder table and a rotary disc.

A time $t_1$ is set by the timer $T_1$ such that the rear end E of a stock is transferred, after it has passed the detection means 12, to a predetermined position A as shown in FIG. 2, which is in a distance D (which will be hereinafter referred to as a stoppage tolerable range) between a stock returning side (left-hand side in FIG. 2), i.e. the rear edge 33 of the rotary disc 3 and a position P where the pressing force of the stock feeding belt 11 is released.

The timer $T_1$ for turning off the power source for the motor when the rear end E of the stock W is moved to a predetermined position A in the stoppage tolerable range D may be substituted by a means consisting of a magnetic tape (not shown) adhered to a side surface of the stock feeding belt 11, a recording head (not shown) whereby a signal representative of the operation of the detection means 12 is recorded thereon, and a reproduction head (not shown) whereby the above-mentioned signal is sensed to break the circuit leading the motor when the signal has been transferred by a predetermined distance or when the rear end E of the stock W has been moved in the stoppage tolerable range D. The power source breaking means may be such a one that consists of a counter (not shown) whereby the amount of rotation of the drive roll 8 for the stock feeding belt 11 is counted so as to break the circuit leading the motor when the stock W has been transferred in the stoppage tolerable range.

Reference numeral 13 denotes a motor braking means connected to the timer $T_1$ and actuated when the operation of the timer $T_1$ has finished. Reference symbol $T_2$ denotes a timer connected to the braking means 13 to start a counting operation when the braking means 13 is actuated and stop the braking means 13 when the operation of the timer $T_1$ has finished or after a predetermined period of time $t_2$ has elapsed. When the operation of the timer $T_2$ has finished, the rear end E of the stock W is stopped in a predetermined position B in the stoppage tolerable range D.

Reference numeral 14 denotes a drive means connected to the timer $T_2$ to drive the rotary disc 3. When the operation of the timer $T_2$ has finished, the disc 3 is rotated. Reference symbol LS1 denotes a limit switch provided inside the stock feeder table 2 and actuated by a dog 43 provided on the rotary disc 3. The limit switch LS1 is operated when the disc 3 is rotated at substantially 180° by the drive means 14, to break the circuit leading to the disc drive means. Reference numeral 15 denotes a braking means connected to the limit switch LS1 to be used for braking the rotary disc 3. The braking means 15 is operated when the limit switch LS1 is actuated. Reference symbol T3 denotes a timer connected to the disc braking means 15. The timer T3 starts a counting operation when the braking means 15 is actuated, and stops the braking means 15 when a predetermined period of time $t_3$ has elapsed, to thereby rotate the motor backwardly.

FIG. 3*b* shows a block diagram of each element in a step of returning and cutting a stock W. This block diagram is identical with the block diagram referred to above in a stock feeding and cutting step except that the former is not provided with a timer $T_1$ but provided with a limit switch LS2 instead of the limit switch LS1, which limit switch LS2 is away from the limit switch LS1 at 180° with respect to the rotary disc 3.

Now, the operation of a carpenter superfinishing planer of the above-described construction will be described.

When a stock W is fed while operating a main switch (not shown) to forwardly rotate a motor for driving a stock feeding belt 11, the stock W is cut by a planer blade 4. When a detection means 12 senses the passage therethrough of the rear end E of the stock W, the timer $T_1$ starts a counting operation. When the rear end E of the stock W is moved, after a predetermined period of time $t_1$ has elapsed, to a predetermined position A in a stoppage tolerable range D on the stock returning side, the timer $T_1$ is deactuated to allow an electric circuit leading to the motor to be opened. At this time, a motor braking means 13 is actuated.

When the motor braking means 13 is actuated, the timer $T_2$ starts a counting operation, and, after a predetermined period of time $t_2$ has elapsed, the operation of the motor is stopped to terminate the operation of the timer $T_2$. At this time, the operation of the braking means 13 is stopped so that the rear end E of the stock is stopped in a predetermined position B in a stoppage tolerable range D.

When the operation of the timer $T_2$ has finished, a disc driving means 14 is actuated, and, when the rotary disc 3 has been rotated at substantially 180°, the limit switch LS1 is closed by a dog 43 provided on the disc 43. As a result, the power source for the disc driving means 14 is turned off and a disc braking means 15 is actuated to thereby operate a timer $T_3$. After a predetermined period of time $t_3$ has elapsed, the operation of the disc braking means 15 is completed to stop the disc 3. When the operation of the time $T_3$ has then finished, the disc braking means 15 is released from its disc braking operation. At this time, the motor for the stock feeding belt 11 is backwardly rotated and the stock is cut again as it is returned, by the planer blade 4 which has been turned round. The stock which has thus been cut again is then returned to the original position at the stock feeding side of the stock feeder table.

When the rear end of the stock with respect to the stock feeding direction has passed through the detection means 12, the power source for the motor is turned off to allow the motor braking means 13 to be actuated, and the timer $T_2$ is thereby operated. When the operation of the timer $T_2$ has been terminated after a predetermined period of time has elapsed, the motor braking means 13 is released from its braking actions and the stock feeding belt 11 stopped at the same time. When the disc driving means 14 is then actuated to allow the disc 3 to be rotated at substantially 180° so that the limit switch LS2 is closed, the disc braking means 15 is actuated to thereby operate the timer $T_3$. When the operation of the timer $T_3$ has been terminated after a predetermined period of time $t_3$ has elapsed, the disc braking means 15 is released from its braking actions to allow the planer blade 4 to be turned round and stopped in a position where the stock can be cut as it is fed. At the same time, the motor for stock feeding belt 11 is forwardly rotated for the preparation of the following cutting operation.

Since the disc in the above-described embodiment is rotated after the motor for driving the stock feeder unit has been stopped, during the feeding and returning of the stock, the motor braking time during which the consumption power is the greatest can be prevented from coinciding the time when the planer blade carrying disc is turned round. Accordingly, the motor can be prevented from being operated unduly and burnt. This allows a smooth planing operation to be carried out.

Since the stock feeder unit in the above-described embodiment is forwardly driven again after the rotary disc has been stopped, during the feeding of the stock, it is never sprung outwardly from the upper surface of the stock feeder table by the actions of the rotary disc. Accordingly, the operator of the planer is never hurt by a stock during the operation thereof. This allows a planing operation to be carried out safely.

Although the invention has been described in its most preferred form with a certain degree of particularity, it is understood that many apparently widely different embodiments of this invention may be made without departing from the spirit and scope thereof and that the invention is not limited to the specific embodiment thereof except as defined in the appended claim.

What is claimed is:

1. A carpenter planer comprising a stock feeder table mounted on a base, a stock feeder vertically adjustably positioned on said table, means for operating said stock feeder to selectively enable feeding of stock in first and second opposite directions on said table, a rotary disc on said table, a planing blade positioned in said disc to cut stock fed thereto by said stock feeder, whereby said planing blade is rotatable with said disc to separate cutting positions corresponding to the feeding of stock in said first and second directions respectively, and control means coupled to control the feed of said stock feeder and to rotate said disc, whereby time lags occur between changing of direction of feed and the rotation of said disc.

2. A caprenter planer according to claim 1, wherein said means for operating said stock feeder comprises a motor, said control unit comprising means for breaking an electric circuit connected to energize said motor when the rear end of stock moved in said first direction by said stock feeder on said stock feeder table has been advanced within a determined stoppage tolerable range between a position which is away from said rotary disc and a position where the stock is released from the force of said stock feeder unit exerted thereon, brake means connected to said electric circuit breaking means so as to start braking said motor after the electric circuit has been broken, and a timer connected to said brake means for terminating the braking of said motor when a predetermined period of time has elapsed after the motor braking operation has started, thereby allowing said rotary disc to be rotated.

3. The carpenter planer according to claim 2, wherein said stock feeder unit comprises a stock feeding belt extending around a pair of rolls, and said electric circuit breaking means comprises detection means positioned at the stock feed portion of said stock feeder table to sense the passage therethrough of stock, and a timer connected to be actuated when said detection means senses the passage of stock to break the electric circuit coupled to said motor when a predetermined period of time has elapsed after said timer has started its operation.

4. A caprenter planer according to claim 2, wherein said stock feeder comprises a stock feeding belt extending around a pair of rolls, and said electric circuit breaking means comprises detection means disposed at the stock feeding portion of said stock feeder table to sense the passage therethrough of stock, a magnetic tape on the side surface of said stock feeding belt and recording therein, by means of a recording head, a signal representative of the operation of said detection means when said detection means senses the passage of stock therethrough, and a reproduction head coupled to sense the signal on said magnetic tape when said signal has been transferred a predetermined distance, to break the electric circuit coupled to said motor.

5. A carpenter planer according to claim 2, wherein said stock feeder comprises a stock feeding belt extending around a drive roll and a driven roll, said electric circuit breaking means comprising detection means positioned at the stock feed portion of said stock feeder table to sense the passage therethrough of the stock, and a counter connected to start counting the amount of rotation of said driven roll when said detection means senses the passage therethrough of stock, and which breaks the electric circuit coupled to said motor when the stock has been transferred in the determined stoppage tolerable range.

6. A carpenter planer according to claim 1, wherein said control unit comprises means for breaking an electric circuit coupled to drive means for said rotary disc immediately before the rotation of said rotary disc has been terminated, said rotary disc being rotated after the rear end of stock, with respect to the direction in which the stock is moved in the second direction by said stock feeder, has come away from the upper surface of said rotary disc and said stock feeder, braking means coupled to said electric circuit breaking means for starting braking of said disc driving means after said electric circuit has been broken, and a timer connected to said braking means and releasing a braking action from said disc driving means when a determined period of time has elapsed after the braking action has started, for driving said stock feeder in said first direction again.

7. A carpenter planer according to claim 6, wherein said electric circuit breaking means comprises a dog on said rotary disc, and two limit switches on said stock feeder table positioned 180° apart so as to permit said limit switches to engage said dog during rotation of said disc.

* * * * *